US006837590B2

(12) United States Patent
Marston

(10) Patent No.: US 6,837,590 B2
(45) Date of Patent: Jan. 4, 2005

(54) ILLUMINATED CAP AND SHOE SET

(75) Inventor: Jez Marston, Mitchellville, MD (US)

(73) Assignee: Jezign, LLC, Silver Spring, MD (US)

( * ) Notice: Subject to any disclaimer, the term of this patent is extended or adjusted under 35 U.S.C. 154(b) by 0 days.

(21) Appl. No.: 10/386,509

(22) Filed: Mar. 13, 2003

(65) Prior Publication Data

US 2003/0151910 A1 Aug. 14, 2003

Related U.S. Application Data

(63) Continuation-in-part of application No. 09/963,787, filed on Sep. 27, 2001, now abandoned.
(60) Provisional application No. 60/235,572, filed on Sep. 27, 2000.

(51) Int. Cl.[7] ..... F21V 21/08

(52) U.S. Cl. ..... 362/103; 362/105; 362/107; 36/29; 36/69; 36/27

(58) Field of Search ..... 362/106, 105, 362/107, 103; 36/29, 69, 27

(56) References Cited

U.S. PATENT DOCUMENTS

| | | | | |
|---|---|---|---|---|
| 4,158,922 A | | 6/1979 | Dana, III | |
| 5,930,921 A | | 8/1999 | Sorofman et al. | |
| 6,007,211 A | * | 12/1999 | Cheung | 362/103 |
| 6,023,784 A | * | 2/2000 | Yeal | 2/9 |
| 6,050,007 A | * | 4/2000 | Angelieri et al. | 36/137 |
| 6,457,261 B1 | | 10/2002 | Crary | |
| 6,618,959 B1 | * | 9/2003 | Sussmann | 36/29 |
| 6,659,618 B2 | * | 12/2003 | Waters | 362/106 |

* cited by examiner

*Primary Examiner*—Stephen Husar
*Assistant Examiner*—Bertrand Zead
(74) *Attorney, Agent, or Firm*—Cahn & Samuels, LLP

(57) ABSTRACT

A combination cap and shoe set is provided wherein each of the cap and shoe include illuminated regions. For example, the brim of the hat may be illuminated in its entirety in a particular color and the sole of the shoe may be illuminated in a complementary color such that a person wearing the cap and shoe of the invention in low light situations may be readily visible. The sole of the shoe may also be substantially uniformly illuminated and the illumination may be controlled independent of any walking motion by the wearer by a manual push-button switch.

3 Claims, 4 Drawing Sheets

ILLUMINATED CAP AND SHOE SET

This application is a continuation-in-part of application Ser. No. 09/963,787 filed on Sep. 27, 2001, now abandoned which claims the benefit of Provisional Patent Application No. 60/235,572 filed Sep. 27, 2000 , and which is herein incorporated by reference.

FIELD OF THE INVENTION

The present invention relates to headgear and footwear containing illuminating elements. More particularly, the present invention relates to caps and/or hats having brims that are fully illuminated and shoes including soles that are switchably illuminated.

BACKGROUND OF THE INVENTION

Night safety for outdoor exercisers, e.g., joggers, pedestrians and cyclists, is an ongoing concern. Most people exercise outdoors either early in the morning before going to work or in the evening or at night after returning from work. In crowded urban environments, outdoor exercisers must frequently share the roads with motorists. Dawn and dusk are periods in which motorist's visibility is notoriously poor. Accordingly, exercisers must take extra precautions to ensure that they are visible to motorists.

In recent years, many exercisers have begun wearing bright or fluorescent colored clothing and/or passive reflectors. However, because these are purely reflective elements, it is necessary for them to be illuminated by an external light source, such as the beam of a motorists headlight, in order for them to function.

There are a several patents directed to caps having light sources attached to their brims. Some patents include caps having external, directed light sources attached to their brims. See for example, U.S. Pat. Nos. 4,406,040 and 5,741,060. The purpose of having light sources on these hats is to enhance the user's visibility so that the user can perform a desired task. However, these hats are not well suited for exercise activities such as jogging, walking or cycling because of the bulky nature of the light source attachment mechanisms. In addition, although they do emit light, they are not designed to make the wearer more visible in low light conditions.

There are still other illuminated caps that employ decorative lighting. For example, U.S. Pat. No. D318,338 includes a light source disposed at the center of the crown of the cap. U.S. Pat. No. 5,510,961 discloses a cap having several LEDs disposed along the perimeter of the brim. Neither of these patents is well suited to making the wearer more visible during low light situations or to providing large areas of illumination.

In recent years, athletic shoe manufacturers have developed a variety of shoes having illuminated regions. Some athletic shoes include illuminated portions on the shoe upper. Other athletic shoes contain illuminated portions in the heel. While still other athletic shoes contain illuminated regions in the instep portion of the sole. Typically, the light sources for these shoes are activated each time the wearer's foot makes contact with a surface and they remain active for a very limited duration (strobe, blink or flash). Thus, the wearer has extremely limited control over the duration of illumination.

SUMMARY OF THE INVENTION

In accordance with a preferred aspect of the invention, a cap having an illuminated region is provided that includes a crown and that may optionally include a brim extending from the crown. In one embodiment, the illuminated region may comprise the entire brim. In other embodiments, the illuminated regions may comprise letters formed in the brim arranged to spell a word or phrase. The illuminated regions may be tinted to radiate light of a particular color, if desired.

In accordance with another embodiment of the invention, shoes having illuminated regions may be provided separate from or in combination with the illuminated cap. The illuminated regions on the athletic shoes preferably include the sole. In some embodiments, the illuminated shoe may be provided with illuminated regions that extend along a substantial portion of the perimeter of the shoe sole. In other embodiments, the illuminated regions may comprise alphanumeric characters formed in the sole and arranged to spell a word or phrase.

DETAILED DESCRIPTION OF THE EMBODIMENTS

The present invention is directed to illuminated caps and shoes individually and in combination. A cap is provided with a plurality of illumination points to make the wearer more visible in low light situations. One or more of the brim of the cap, the seams of the crown of the cap and the button at the junction of the seams of the cap may be illuminated in accordance with the invention. Likewise, an athletic shoe may be provided with a plurality of illuminated regions including the tongue of the shoe, the entire sole of the shoe or portions thereof, the supporting material for the shoelace eyelets, decorative stripes disposed on the side of the shoe as well as other regions.

With respect to the cap, the illuminated brim is preferably the same size and shape as a regular brim that one would see in an ordinary baseball cap. There could be many different colored brims and hat matches, for instance the hat itself could be white while the brim is blue or any other color, or the hat could be red with a red illuminated brim. There are almost countless combinations. The brim is preferably comprised of a plastic or PLEXIGLAS® type of material molded into the shape of a regular brim that one would see today on a regular baseball cap. Likewise, the other illuminated regions may be of the same or different colors from each other. The owner of the cap has the choice of having his hat illuminated or off because of a switch that is preferably concealed underneath the material of the head fitting part of the hat. The owner of the hat can operate this switch through the material or fabric. The illuminated regions of the shoe may be color coordinated with the hat, if desired to present a well-coordinated apparel accessory set.

Figure 1:
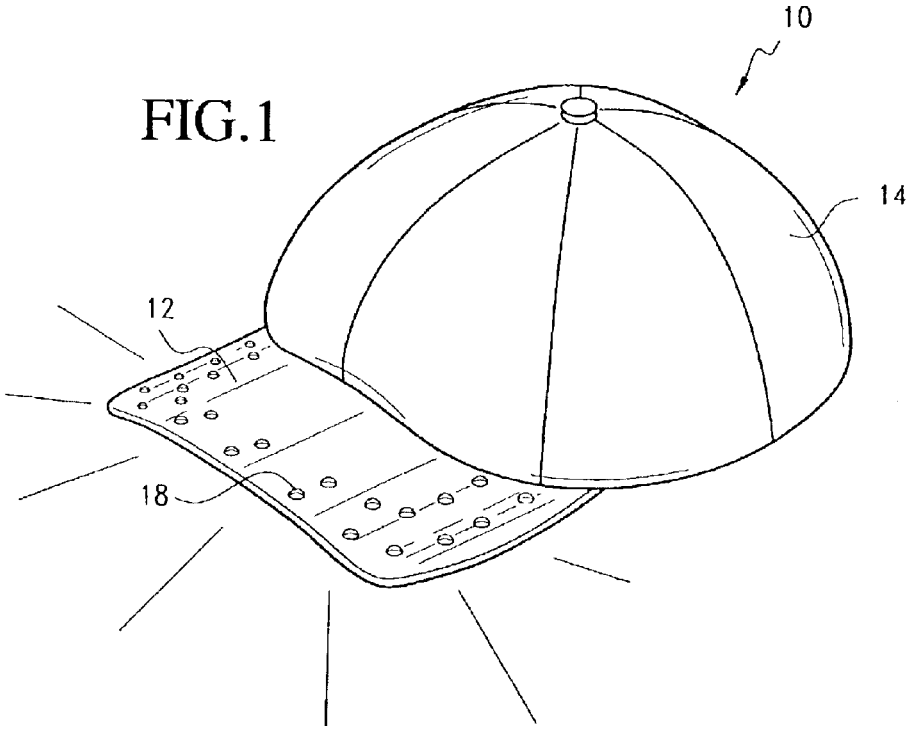
FIG. 1 depicts an illuminated cap in accordance with an embodiment of the invention.

FIG. 1 depicts a cap according to the invention. As illustrated, a cap 10 includes a brim 12 and a crown 14. Cap 10 may be in the style of a baseball cap, a fishing cap, or any other hat/cap that employs a brim. Brim 12 is preferably formed from polymeric material that permits substantial transmission of light, e.g. PLEXIGLAS®. Crown 14 may be formed from a breathable fabric such as cotton or canvas and brim 12 may be attached to crown 14 by any well known method.

Figure 1A:
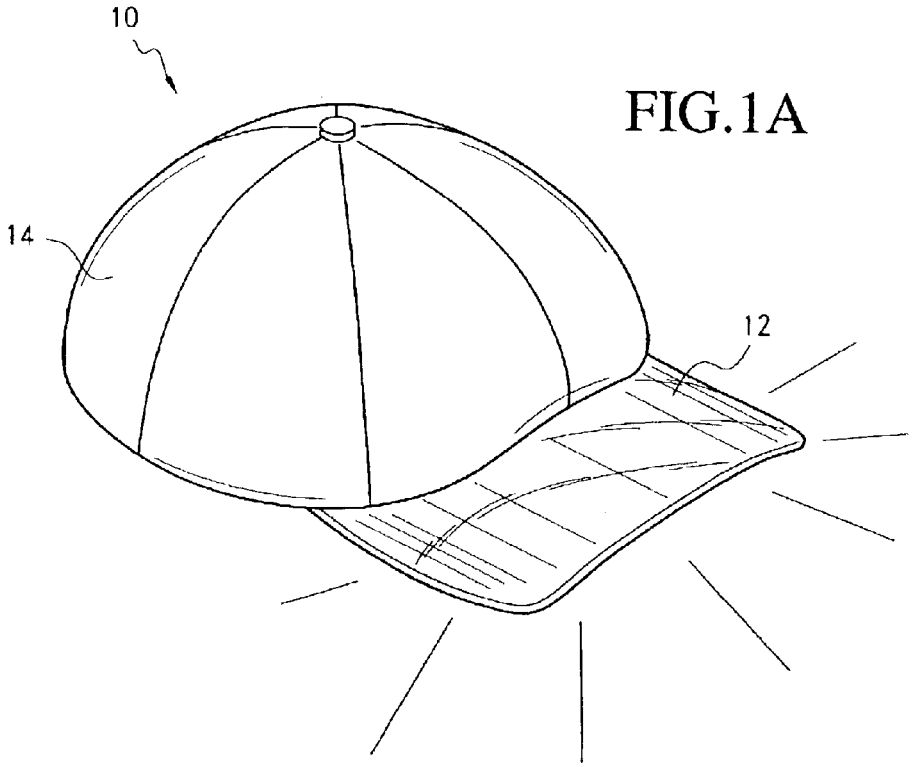
FIG. 1A depicts an illuminated cap in accordance with another embodiment of the invention.
Figure 2:
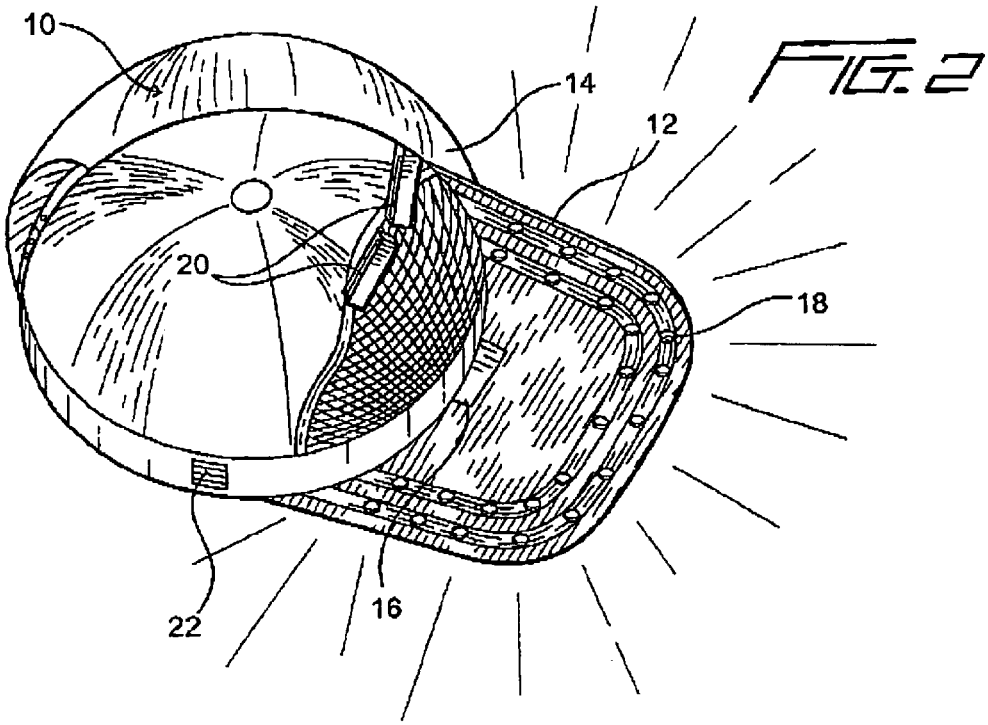
FIG. 2 is a bottom view of the illuminated cap of FIG. 1.

In accordance with an aspect of the invention, as depicted in FIG. 2, a light source 16 is provided to illuminate brim 12. Light source 16 may include light emitting elements 18 and a power source 20 and switch 22. Alternatively, a single light source may be provided as illustrated in FIG. 1*a*. Light emitting elements 18, e.g., LEDs, are preferably embedded within brim 12 to facilitate maximum light generation. Upon illumination of light emitting elements 18, brim 12 may act as a lens and to magnify the intensity of light emitting elements 18 thus illuminating the entire surface area of brim 12 and creating significant radiation. If further enhancement of illumination is desired, small reflective particles may be embedded into brim 12.

It is particularly preferred that brim 12 be substantially uniformly illuminated over its entire surface area. To that end, the polymeric material of brim 12 preferably diffuses light emanated from light source 18 so that there is a minimal light intensity differential from light source 18 across the surface area of brim 12. Exemplary diffusing technology is disclosed in U.S. Pat. No. 5,879,076 that is herein incorporated by reference.

Alternatively, brim 12 may comprise a substantially opaque material having a plurality of translucent regions variously shaped and arranged. In keeping with a preferred aspect of the invention, the translucent regions may be formed in the shape of alphanumeric characters and arranged to display a message, i.e., a word, phrase or grouping of numbers. This illuminated message feature is particularly advantageous for manufacturers of athletic apparel as it can function as conspicuous advertising.

Power source 20 may be a small battery with sufficient strength to power light emitting elements 18. Power source 20 is preferably disposed on an inner surface of crown 14 such that it is concealed from plain view.

To facilitate manual activation of lighting elements 18, switch 22 is preferably a small push button switch of type commonly known in the art. Switch 22 may be disposed within an interior crown sweatband or liner and thereby hidden from view. The wearer can illuminate brim 12 by simply applying pressure to the outer surface of crown 14 at the hidden switch 22.

In order to present a sleek, fashionable look, power source 20 and switch 22 are preferably concealed on an inner rim of crown 14. In addition, it may be desirable for the brim 12 to radiate colored light. To that end, lighting elements 18 may be colored and/or brim 12 may be tinted.

Figure 3:
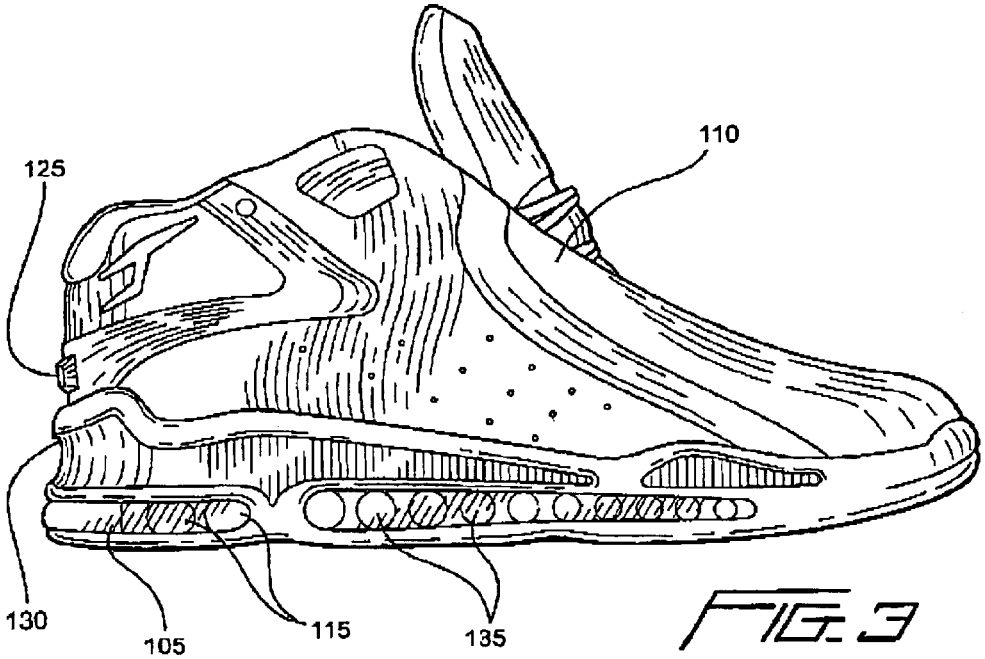
FIG. 3 is a side view of a shoe in accordance with the invention.

In accordance with another embodiment of the invention, the illuminated cap 10 described above may be combined with illuminated athletic shoes 30 illustrated in FIG. 3. A suitable athletic shoe 30 is described U.S. Pat. No. 5,285,586 which is incorporated herein by reference. This combination may be worn as a fashion item or it may be used by performers such as dancers, actors marching band members and athletes in low light conditions to achieve special visual effects. For example, a marching band equipped with the combination illuminated hat and illuminated athletic shoes in accordance with the invention may present an impressive spectacle, as the individually illuminated heads and feet of its members move in synchronicity and create a symphony of light.

Figure 4:
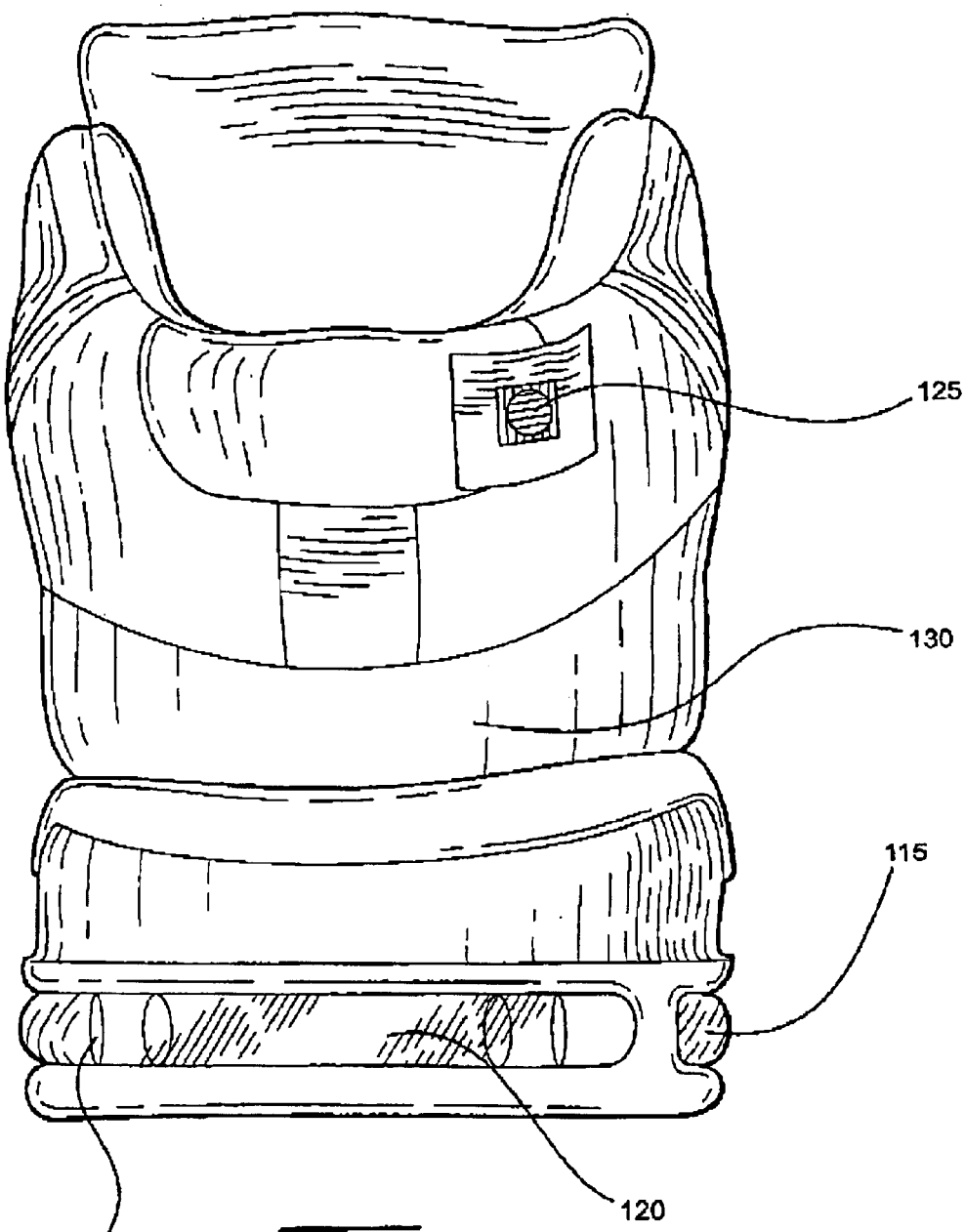
FIG. 4 is a rear view of a shoe in accordance with the invention.

FIG. 3 illustrates a shoe in accordance with still another embodiment of the invention. The shoe includes a sole 105 attached to upper 110. Sole 105 includes a translucent perimeter surface 115 having a light source 120 disposed therein. In keeping with the invention, light source 120 is preferably connected to a push-button switch 125 disposed on rear quarter 130, as shown in FIG. 4. Push-button switch 125 may optionally be concealed within the material of quarter 130.

To capture the desired visual effects of the invention, it is important that sole 105 be substantially uniformly illuminated across the entire perimeter surface 115. To that end, light source 120 may comprise a plurality of light emitting devices 135 contiguously positioned so as to appear to form a substantially uniform illumination pattern across perimeter surface 115.

In accordance with another aspect of the invention, unlike many of the prior art illuminated shoes, the illuminated shoe of the present invention employs push-button switch 125 that facilitates continuous illumination when activated. Continuous illumination provides greater user control of the duration and timing of illumination and provides increased visibility over prior art shoes that employ blinking, strobing, flashing or intermittent light sources that are activated only when the wearer's foot makes contact with a surface.

Figure 5:
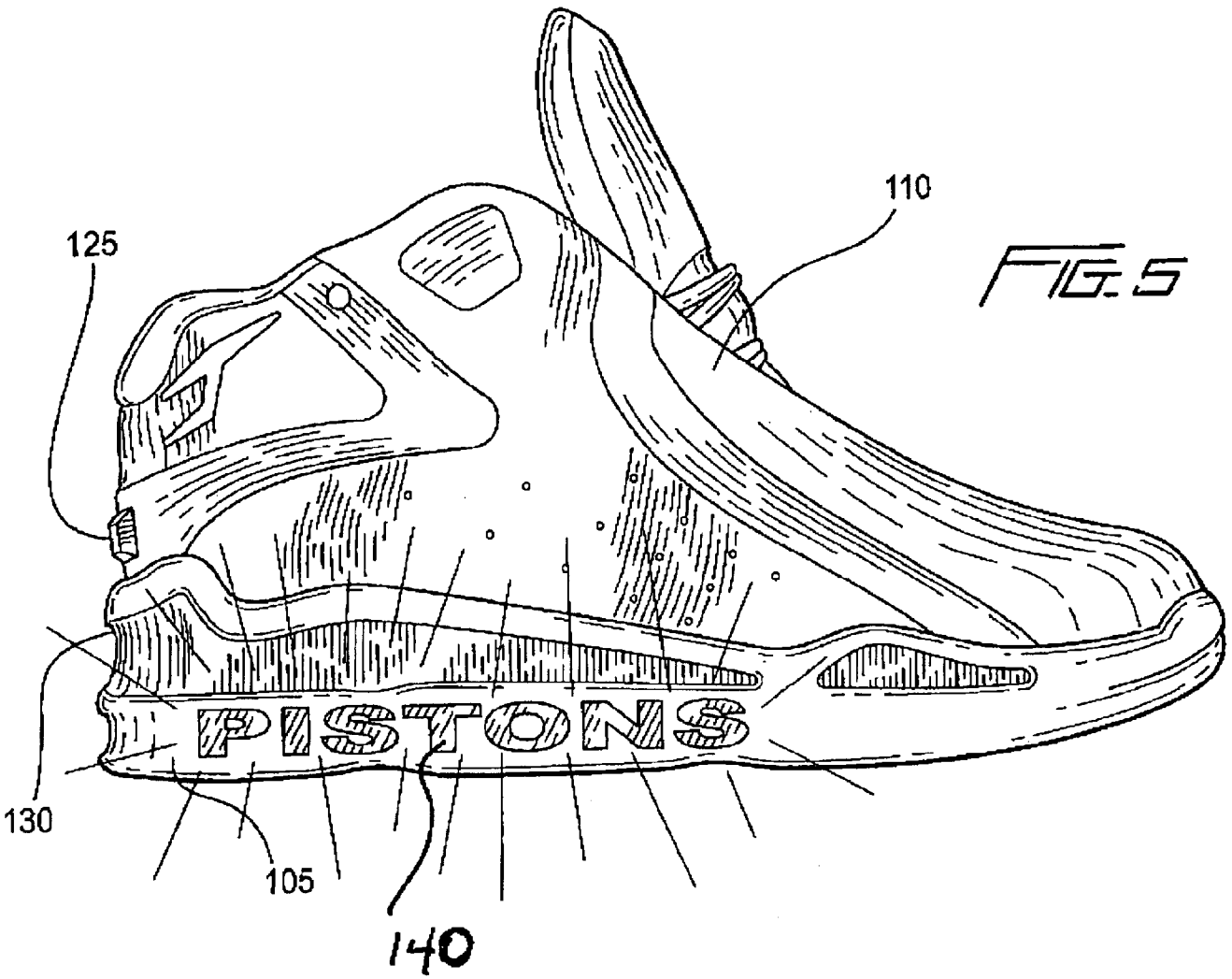
FIG. 5 is a side view of the shoe in accordance with an embodiment of the invention.

In connection with still another embodiment of the invention, as illustrated in FIG. 5, sole 115 may be generally opaque and include translucent regions 140 variously shaped and arranged. For example, in some applications, translucent regions 140 may be in the shape of letters arranged to display a message, i.e., a word, phrase or a numeric phrase. Exemplary messages include the shoe manufactures' name or the wearer's name or number. In the case of an athletic team, translucent regions 140 may be arranged to spell the team name or school name. For example, in some applications, translucent regions 140 may be in the shape of letters arranged to display a message, i.e., a word, phrase or a numeric phrase. Exemplary messages include the shoe manufactures' name or the wearer's name or number. In the case of an athletic team, translucent regions 140 may be arranged to spell the team name or school name.

The translucent regions may be illuminated according to a number of different patterns. In keeping with one aspect of the invention, the translucent regions may be illuminated substantially uniformly or different regions may be illuminated to different intensity levels. In accordance with another aspect of the invention, the translucent regions may be illuminated synchronously, sequentially or according to any desired pattern.

The inventive combination is also particularly useful for joggers, pedestrians and cyclists as illuminating the head and feet thereby significantly increasing visibility.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An illuminated shoe comprising:

an upper;

a sole attached to said upper, the sole including a translucent perimeter surface;

a light source disposed within said sole; and a push-button switch coupled to said light source to activate the light source such that the light source provides continuous illumination across a substantial portion of the perimeter surface regardless of whether the wearer is standing still or walking.

2. The illuminated shoe of claim 1 wherein said light source includes a plurality of contiguous light emitting devices disposed in said sole that form a substantially uniform illumination pattern across the perimeter surface.

3. An illuminated shoe comprising:

an upper;

a sole attached to said upper, the sole including an opaque perimeter surface having a plurality of translucent regions, the translucent regions being formed in the shape of alpha numeric characters and being arranged to spell a word;

a light source disposed within said sole such that said light source provides illumination to the plurality of translucent regions; and a push-button switch coupled to said light source to facilitate activation of the light source for user selected periods of time independent of whether the wearer is standing still or walking.

* * * * *